US005766088A

United States Patent [19]

Severtsen

[11] Patent Number: 5,766,088

[45] Date of Patent: Jun. 16, 1998

[54] SWING WEIGHT ADJUSTMENT ASSEMBLY AND METHOD

[76] Inventor: Joseph Severtsen, 9845 Hudson, Rockhill, Mo. 63119

[21] Appl. No.: 786,649

[22] Filed: Jan. 21, 1997

[51] Int. Cl.[6] ..... A63B 53/08

[52] U.S. Cl. ..... 473/297

[58] Field of Search ..... 473/297–303, 473/282, 284, 285, 286, 288, 519

[56] References Cited

U.S. PATENT DOCUMENTS

| | | | |
|---|---|---|---|
| 1,026,990 | 5/1912 | Matson | 473/519 |
| 1,528,190 | 3/1925 | Howe | 473/298 |
| 1,709,546 | 4/1929 | Stanton | 473/284 |
| 2,178,872 | 11/1939 | Engstrom | 473/285 |
| 4,600,195 | 7/1986 | Hunter | 473/297 |
| 5,244,210 | 9/1993 | Au | 473/336 |

*Primary Examiner*—Sebastiano Passaniti
*Assistant Examiner*—Stephen L. Blau
*Attorney, Agent, or Firm*—Henry W. Cummings

[57] ABSTRACT

In accordance with the present invention, an assembly to change the swing weight of a club is provided, including a resilient elastomeric member, which is hollow, and which has a cylinder wall adopted to extend downwardly along the outer end of the grip. A flange is provided at the outer end of the weight to engage the end portion of the grip to hold the weight in place. The weight is sized to fit the diameter of the grip of the club. Additional weights maybe inserted inside the weight abutting the flange to increase the swing weight. An example of a suitable additional weight member, is a coin such as a penny, nickel, dime or quarter. It is a simple matter to remove the weight member and remove one or more coins to change the swing weight of the club.

9 Claims, 2 Drawing Sheets

SWING WEIGHT ADJUSTMENT ASSEMBLY AND METHOD

FIELD OF THE INVENTION

This invention relates to an assembly for adjusting the swing weight of a golf club.

BACKGROUND OF THE INVENTION

U.S. Pat. No. 3,075,768 discloses a golf club having a hollow shaft and a compartment in the end of the shaft with individual solid particular weighting material in the shaft. A grip is located at the top of the shaft, with an opening in the grip, just large enough to permit introduction of individual particular weight means.

However, in this design, the weight means is located inside a hollow golf club shaft and it is difficult in this design to remove weighted material if it is desired to adjust the playing weight to a lower weight.

U.S. Pat. No. 5,244,209, discloses a grip apparatus for a golf club, including a hollow cylindrical plug and a compartment inside the plug, for holding weighted material. However, in this design, the plug is located within the grip, making changing the weight more difficult and awkward than in the present invention.

In U.S. Pat. No. 4,690,407, a golf club includes a grip with a weighted element attached to the distal end of the club. The weight element is secured within the grip in the shape of an inverted cup. However in this design, it is more time consuming and awkward to change the weighted element, than in the present invention.

U.S. Pat. No. 4,988,102, discloses a golf club grip, including a weighted element, which relies on a layer of adhesive tape and solvent to hold the weighted element in place. This is not necessary in the arrangement of the present invention.

In U.S. Pat. No. 4,461,479, a weighted member is mounted on the golf club between the balance point and the outer end of the golf club. In the present invention, the weighted member is located at the outer end of the grip.

In U.S. Pat. No. 5,374,062, a swing weight is located within the tubular shaft of the golf club. In the present invention, the weight is located on the outer end of the grip.

In U.S. Pat. No. 5,460,378, the weight means is located near the golf club head. In the present invention, the weight is located on the outer portion of the grip.

In U.S. Pat. No. 5,152,527, additional weight is located at or below the center of gravity of the hand position on the gripping region. In the present invention, the additional weight is located on the outer end of the grip.

In U.S. Pat. No. 3,466,047, a weighted plug is inserted into the golf club head. In the present invention, weight is added to the outer end of the grip.

SUMMARY OF THE INVENTION

A. Objects of the Invention

One object of the present invention is to provide a weight to change the swing weight of a golf club, which is easily installed and removed to facilitate easily and quickly changing the swing weight of the club.

Another object of the present invention, is to provide a weight assembly for changing the swing weight of a club, which is inexpensive.

Another object of the present invention, is to provide an assembly for changing the swing weight of a club, which does not require changing the existing shape of the club and grip. Other objects will be apparent from the following description and drawings.

B. Summary

In accordance with the present invention, an assembly to change the swing weight of a club is provided, including a resilient elastomeric member, which is hollow, and which has a cylinder wall adopted to extend downwardly along the outer end of the grip. A flange is provided at the outer end of the weight to engage the end portion of the grip to hold the weight in place. The weight is sized to fit the diameter of the grip of the club. Additional weights maybe inserted inside the weight abutting the flange to increase the swing weight. An example of a suitable additional weight member, is a coin such as a penny, nickel, dime or quarter. It is a simple matter to remove the weight member and remove one or more coins to change the swing weight of the club.

THE DRAWINGS

V DESCRIPTION OF THE PREFERRED EMBODIMENTS

Figure 1:
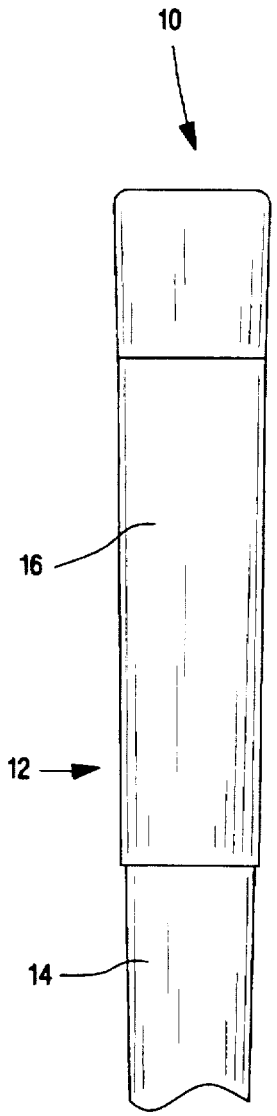
FIG. 1 is a side elevation view of a golf club, with the weight assembly of the present invention in place upon the grip.
Figure 2:
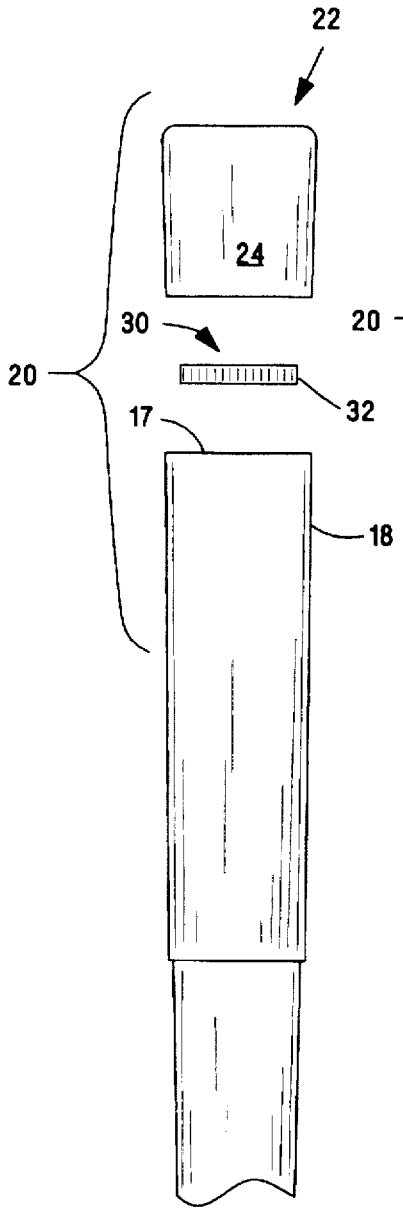
FIG. 2 is a an exploded, side elevation view of an alternative embodiment, illustrating a coin to be utilized between the grip and the weight member of the present invention.
Figure 3:
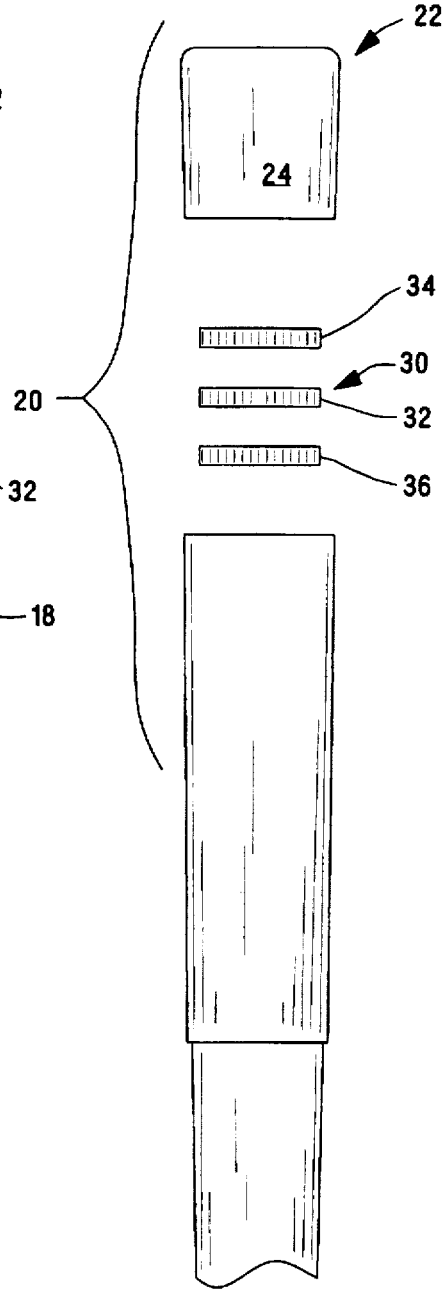
FIG. 3 is an exploded, side elevation view illustrating three coins to be utilized in conjunction with the weight member and a grip of the present invention.
Figure 6:
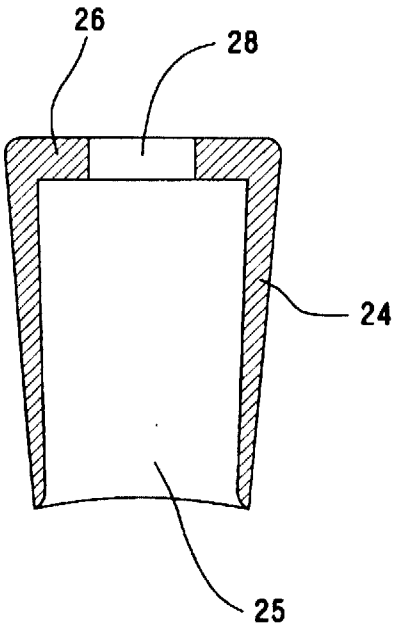
FIG. 5 is a side elevation view of the weight member of the present invention and FIG. 6 is a sectional view, looking in the direction of the arrows along the line 6—6, in FIG. 5.
Figure 5:
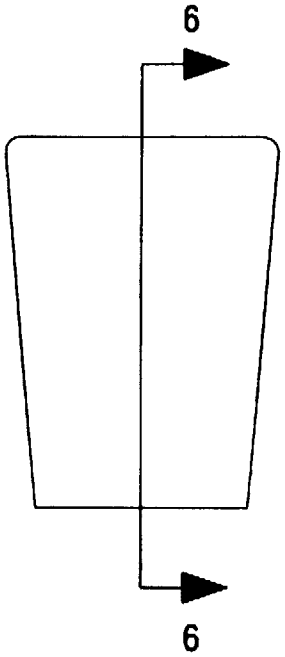
Figure 4:
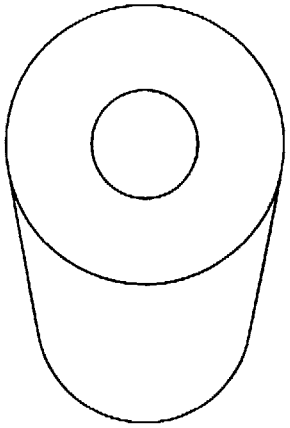
FIG. 4 is a perspective view of the weight element of the present invention.

In accordance with the present invention, a golf club weight assembly 10, is provided for use in connection with a golf club 12, having a shank 14, connected to club face, (not shown). A grip 16, of known construction, surrounds the shank portion 14.

The weight assembly 20, includes a weight member 22, having a body portion 24, which is hollow and generally cylindrical and and adopted to be placed on the grip portion 16. The weight member 22, includes a shoulder 26, having an optional opening 28.

The weight member is made of a elastomeric material, having sufficient resilience to fit around the grip 16, with a removable interference fit, and having sufficient rigidity to remain in place while the club is swung and a golf ball impacted. In one embodiment the weight member further has sufficient resilience to hold in place one or more additional weight members indicated generally at 30, which may include a plurality of coins 32, 34, 36. The coins may comprise nickels, dimes, or quarters or coins from other jurisdictions. Quarters have been found to be particularly adaptable to the present invention.

The size of the slot or opening 25, inside the body portion 24, is dimensioned so as to fit on the end 17, of the grip 16, and along the end portion 18, of the grip, with an interference fit, which is sufficiently strong to hold the weight member 22 in place, and one or more additional weight members 30 in place during use of the club, including swinging the club and absorbing the reaction force encountered from hitting a golf ball with the club 12.

However, the interference fit is not so great that the weight member 22, cannot be removed to insert larger weight members 22, and/or one or more supplemental weight members 30, located within the slot 25.

In this regard, the elastomeric material, preferably has a Durometer value of about 25 to 50 Shore D Scale. Any of the known elastomeric materials, including polymers and co-polymers polyethylene, polypropylene, polystyrene, and many others known to those skilled in the art, maybe utilized.

An example of a weight member 22, which can be purchased and is commercially available as a cane tip in Hardware Stores.

After experimentation, a golfer will discover the optimum swing weight a particular club. If desired, the club can then be weighted permanently by a Clubmaker.

A particularly advantageous feature of the present invention, is that it is very inexpensive. The weight members 22, may be presently purchased for fifty cents or less. The coins are inexpensive as well. Even if three coins are used and they are quarters, this is only seventy-five cents. Compared to the purchase price of other golf equipment designed to improve ones game, the weight assembly of the present invention is uniquely inexpensive.

What is claimed is:

1. In a golf club assembly comprising:

a golf club handle, a grip attached to an upper end portion of said handle;

the improvement comprising a weight assembly, including a weight member and at least one additional weight member; said weight member having a body portion made from an elastomeric material having a Durometer value of from 25 to 50 Shore, D Scale; said body portion being hollow to define a body portion slot and having a shoulder extending around the upper end portion of said grip; said body portion slot being dimensioned such as to engage said grip with an interference fit of sufficient strength to maintain said weight member and said additional weight member in place during swinging of a club and impacting a golf ball with the club and at the same time, sufficient resilience to be removable, for installation or removal of additional weight members.

2. An improved golf club, according to claim 1, wherein more than one additional weight member is held in place, upon said grip, with said weight member.

3. A golf club weight assembly, comprising:

a golf club weight member, and at least one additional eight member; said weight member having a generally cylindrical body portion, made of an elastomeric material having a Durometer value of from about 25 to 50, shore D Scale and adopted to engage the outer end portion of a golf club grip, and having a transversely extending shoulder, adopted to extend transversely along the end portion of said grip member; said elastomeric material, having sufficient strength to engage said grip portion and remain in place upon said grip when said club is swung, and when a golf ball is impacted; and having sufficient resilience to be removable from said grip to install or remove additional weight members.

4. A weight assembly, according to claim 3, wherein more than one supplemental weight member is located within said weight member.

5. A weight assembly, according to claim 4, wherein said additional weight members comprise coins.

6. A weight member according to claim 5, wherein said coins are selected from pennies, nickels, dimes and quarters.

7. A weight member according to claim 6, wherein said coins are quarters.

8. A method of changing the swing weight of a golf club comprising: providing a golf club having a handle portion and a grip member having an outer end portion located upon said handle;

placing upon the outer end portion of said grip member, a weight assembly, including a weight member and at least one additional weight member; said weight member having a hollow body portion, engaging said grip with an interference fit; said weight member further, having a shoulder, extending transversely along the upper end of said grip member to provide additional weight to said golf club; said weight member being made of an elastomeric material, having sufficient strength to engage said grip portion, and remain in place during swinging of the club and during impact of the club with the ball, and sufficient resilience to be removable, for installation or removal of additional weight members; said elastomeric material having a Durometer value of about 25 to 50 Shore D Scale.

9. A method according to claim 8, including inserting more than one additional weight, adjacent said grip and held in place with said shoulder.

* * * * *